US009331418B2

(12) United States Patent
Chung

(10) Patent No.: US 9,331,418 B2
(45) Date of Patent: May 3, 2016

(54) MINI SERIAL ATTACHED SCSI HIGH DENSITY CONNECTOR

(71) Applicant: TC&C Electronic CO., LTD., Taoyuan County (TW)

(72) Inventor: Li Hua Chung, Taoyuan County (TW)

(73) Assignee: TC&C Electronic Co., Ltd., Zhongli, Taoyuan County (TW)

( * ) Notice: Subject to any disclaimer, the term of this patent is extended or adjusted under 35 U.S.C. 154(b) by 0 days.

(21) Appl. No.: 14/476,818

(22) Filed: Sep. 4, 2014

(65) Prior Publication Data

US 2015/0194760 A1 Jul. 9, 2015

(30) Foreign Application Priority Data

Jan. 3, 2014 (TW) ..... 103200125 U

(51) Int. Cl.

| | |
|---|---|
| ***H01R 24/00*** | (2011.01) |
| ***H01R 13/514*** | (2006.01) |
| ***H01R 24/60*** | (2011.01) |
| *H01R 13/518* | (2006.01) |

(52) U.S. Cl.

CPC ..... *H01R 13/514* (2013.01); *H01R 24/60* (2013.01); *H01R 13/518* (2013.01)

(58) Field of Classification Search

CPC ..... H01R 24/60; H01R 24/00; H01R 13/514; H01R 13/627

USPC ..... 439/676, 660, 345, 607.01, 652, 352, 439/358, 152, 153, 76.1, 418

See application file for complete search history.

(56) References Cited

U.S. PATENT DOCUMENTS

| | | | | |
|---|---|---|---|---|
| 6,837,738 | B1 * | 1/2005 | Chen | 439/418 |
| 7,364,465 | B2 * | 4/2008 | Wu | 439/607.55 |
| 7,651,342 | B1 * | 1/2010 | Wu | 439/76.1 |
| 7,803,010 | B1 * | 9/2010 | Hwang | 439/497 |
| 8,251,735 | B2 * | 8/2012 | Wu | 439/353 |
| 8,292,637 | B2 * | 10/2012 | Wu | 439/76.1 |
| 8,506,331 | B2 * | 8/2013 | Wu | 439/607.18 |
| 8,550,848 | B2 * | 10/2013 | Wu | 439/607.18 |
| 8,770,990 | B2 * | 7/2014 | Sytsma et al. | 439/76.1 |
| 8,926,339 | B2 * | 1/2015 | Houtz | 439/76.1 |
| 2011/0136368 | A1 * | 6/2011 | Wu | 439/345 |
| 2012/0129396 | A1 * | 5/2012 | Wang et al. | 439/607.01 |
| 2012/0214324 | A1 * | 8/2012 | Wu | 439/271 |
| 2012/0214345 | A1 * | 8/2012 | Wu | 439/607.19 |
| 2012/0214350 | A1 * | 8/2012 | Wu | 439/676 |
| 2013/0095676 | A1 * | 4/2013 | Wu | 439/76.1 |
| 2013/0231011 | A1 * | 9/2013 | Sytsma et al. | 439/723 |

* cited by examiner

*Primary Examiner* — Hae Moon Hyeon
*Assistant Examiner* — Peter G Leigh
(74) *Attorney, Agent, or Firm* — Charles E. Baxley

(57) ABSTRACT

A mini SAS HD connector comprises: front and rear housings combined together, wherein the rear housing comprises first and second rear shell pieces; a positioning mechanism disposed between the first and second rear shell pieces and providing a positioning effect; a first combination mechanism disposed between the front and rear housings and providing a combination effect when the front and rear housings are combined; and combinations of a first inner module, a second inner module and circuit boards. The combination of the first inner module and the circuit board is mounted in the first rear shell piece. The combination of the second inner module and the circuit board is mounted in the second rear shell piece. Stopper mechanisms are provided between the first inner module, the second inner module and the circuit boards, so the circuit boards have no distinct displacement due to plugging and unplugging operations of the connector.

12 Claims, 14 Drawing Sheets

MINI SERIAL ATTACHED SCSI HIGH DENSITY CONNECTOR

BACKGROUND OF THE INVENTION

1. Field of the Invention

The invention relates to the technical field of an electronic apparatus connector, and more particularly to a combination structure of a housing and circuit boards of a mini serial attached SCSI high density (mini SAS HD) connector.

2. Related Art

In general, a computer and its peripheral apparatus transmit signals through a suitable bus line or cable. The end portion of the bus line or the cable is formed with a connector to be assembled with or inserted into the computer or its peripheral apparatus. The connector may be, for example, a USB connector, a RJ45 connector, a parallel to serial port connector, a SATA connector, a mini SAS HD connector or the like.

At present, the combination structure of the mini SAS HD connector comprises a front housing and a rear housing combined together. Furthermore, two circuit boards are covered within a rear housing in the processing of molding the rear housing. Then, the combination of the rear housing and the circuit board is inserted into the front housing. Because the circuit board and the rear housing are integrally formed, the circuit board is placed in the high-temperature environment and is thus easily damaged.

Taiwan Patent No. 1321380 discloses a combined connector, which comprises two members clamping one circuit board, and then the two members and the circuit board are combined into the combination of a rear housing and the circuit boards by way of welding. The combination of the rear housing and the circuit boards may be used in conjunction with a combination of a locking structure and a front housing.

This structure has the easily assembling effect, and the height of the housing can be stably held within a predetermined error range so that the higher product yield is obtained. However, the two members need to be welded to form the rear housing, and this still has the drawback that the manufacturing is inconvenient. In addition, when the two members are welded together, no suitable positioning structure is provided. Thus, the bad product tends to be formed.

Also, the two parallel circuit boards of the connector having the mini SAS HD specification need to be configured to have a predetermined gap. Thus, when the two circuit boards are arranged, the suitable tool or jig has to be used, thereby enhancing the inconvenience of assembling. In addition, it is to be noted that the plugging and unplugging operations of the connector cannot cause the displacement of the circuit boards.

SUMMARY OF THE INVENTION

An object of the invention is to provide a mini serial attached SCSI high density (Mini SAS HD) connector, which has the small size and can be rapidly assembled, can improve the problem of the too large sway swing angle caused by the length design of the connector and eliminate the condition of the unstable signal, further can reduce the interference with other mechanisms by the small size, and can enhance the space availability and the matching degree with other mechanisms.

Another object of the invention is to provide a mini SAS HD connector, which prevents the circuit board, mounted in the connector, from generating the distinct displacement by the operation of plugging and unplugging, so that the connector has the stable connection effect.

Still another object of the invention is to provide a mini SAS HD connector having the function of inwardly fastening and positioning the braided mesh, so that the effect of easy assembling can be obtained, and the braided mesh cannot be easily moved and loosened to obtain the effect of preventing the cable from being damaged by the external force.

To achieve the above-identified objects and effects, the invention provides a connector comprising: a front housing, which is in the form of a frame and has an axial insertion space; a rear housing comprising a first rear shell piece and a second rear shell piece combined together; a positioning mechanism, which is disposed between the first rear shell piece and the second rear shell piece, and provides a positioning effect when the first rear shell piece and the second rear shell piece are combined together; and a first combination mechanism, which is disposed between the front housing and the rear housing and provides a combination effect when the front housing and the rear housing are combined together. The rear housing composed of the first rear shell piece and the second rear shell piece is inserted into the insertion space of the front housing.

The connector further comprises a first inner module and a second inner module. Each of the first inner module and the second inner module is combined with a circuit board. The combination of the first inner module and the circuit board is mounted in the first rear shell piece, and the combination of the second inner module and the circuit board is mounted in the second rear shell piece.

Because the rear housing comprises the first rear shell piece and the second rear shell piece assembled in conjunction with the positioning mechanism and the second combination mechanism, the assembling process of the rear housing is rapid and convenient. Also, the rear housing and the front housing are combined in conjunction with the first combination mechanism, and the assembling process is similarly rapid and convenient.

Furthermore, the first inner module and the second inner module may be stably engaged with the first rear shell piece and the second rear shell piece, so the circuit board is free from the distinct displacement due to the plugging and unplugging operations of the connector.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

The present invention will be apparent from the following detailed description, which proceeds with reference to the accompanying drawings, wherein the same references relate to the same elements.

Figure 1:
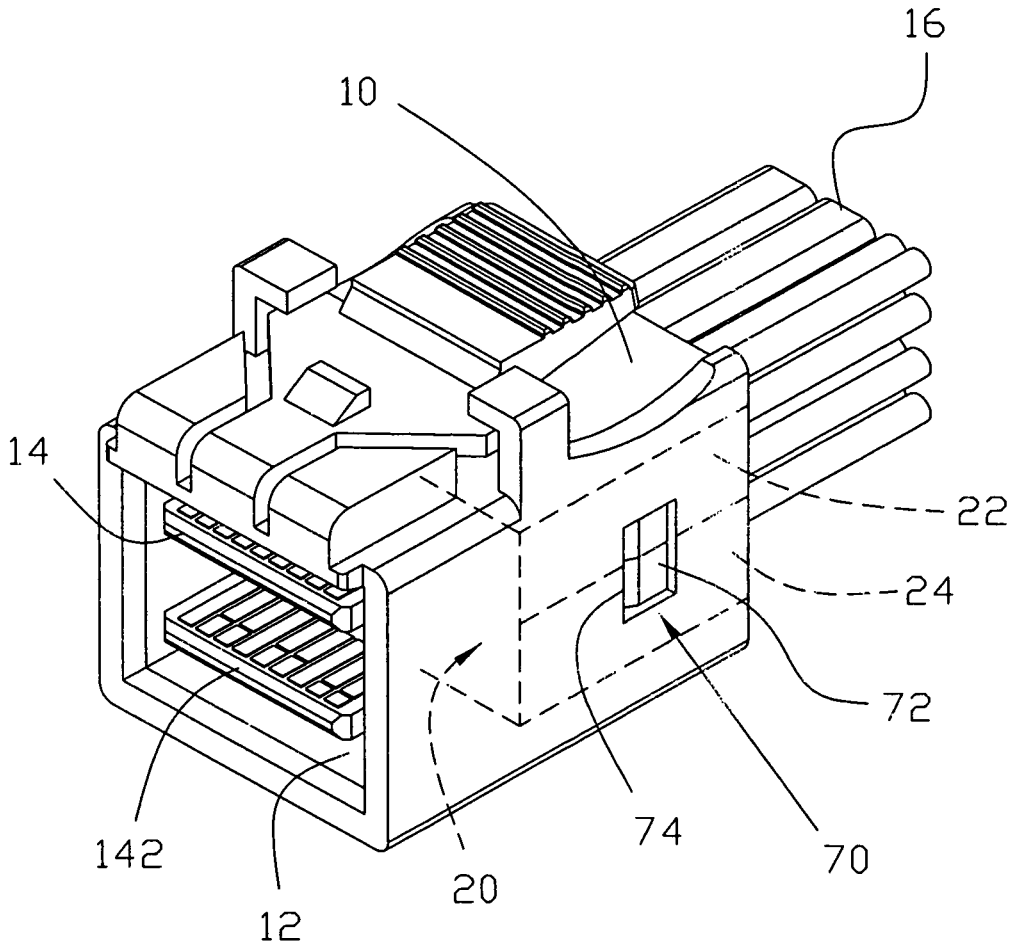
FIG. 1 is a pictorial view showing a first embodiment of the invention.

Referring to FIG. 1, a short-type mini SAS HD connector includes a front housing 10 and a rear housing 20. The front housing 10 has a frame structure, and an insertion space 12 in an axial direction. The rear housing 20 includes a first rear shell piece 22 and a second rear shell piece 24 combined together, and the rear housing 20 can be combined with a circuit board or circuit boards 14 and 142. The first circuit board 14 and the second circuit board 142 can be combined with a cable 16. Furthermore, the rear housing 20 can be completely or almost completely inserted into the insertion space 12 of the front housing 10.

Figure 2:
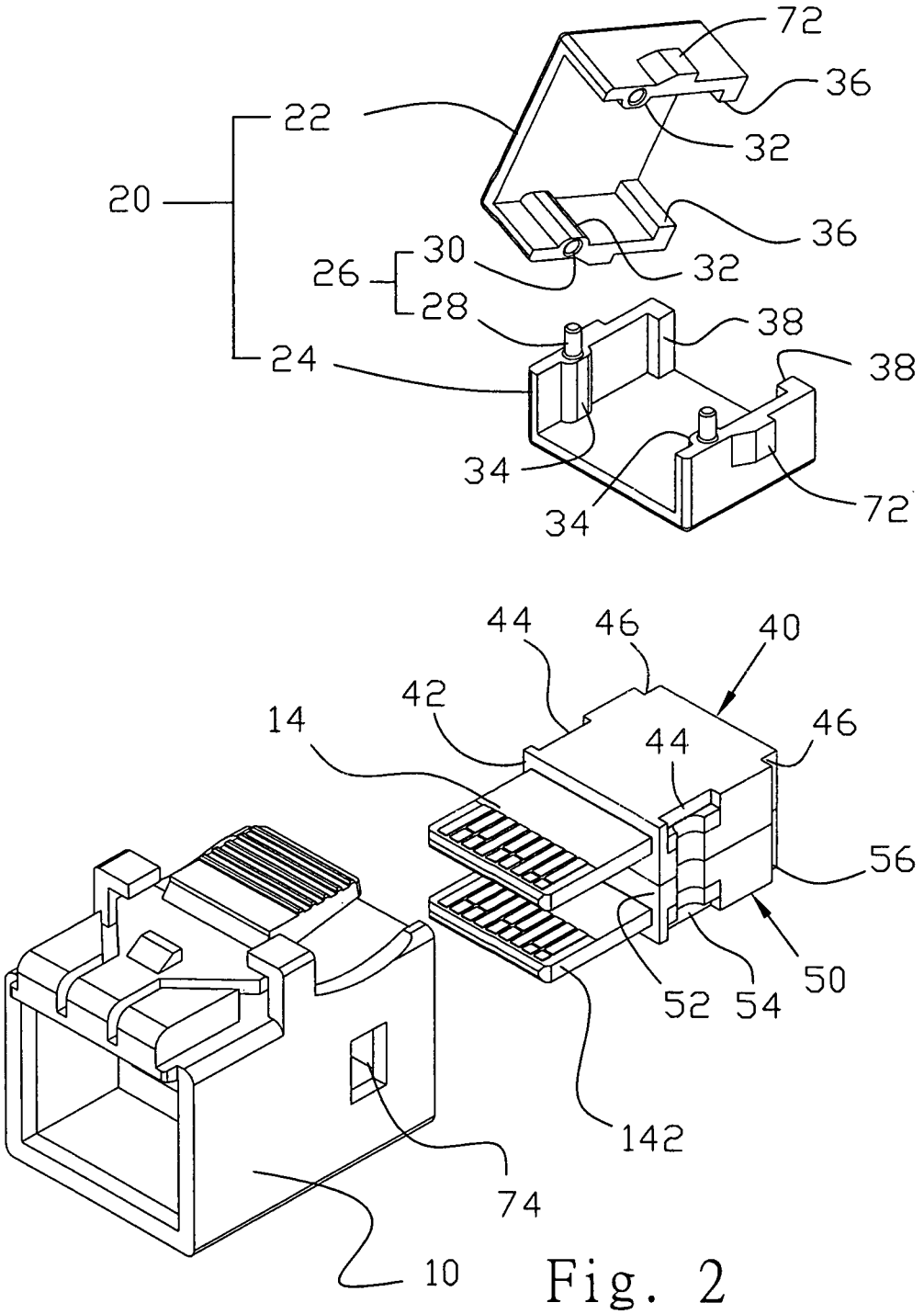
FIG. 2 is an exploded view showing the first embodiment of the invention.

Referring to FIG. 2, a positioning mechanism 26 is further provided between the first rear shell piece 22 and the second rear shell piece 24. When the first rear shell piece 22 and the second rear shell piece 24 are assembled together, the better combination effect can be formed in conjunction with the positioning mechanism 26. The positioning mechanism 26 may be a combination of a positioning pin 28 and a pin hole 30, or a combination of members with the same property, such as a combination of an insert and a concavity.

Also, a first projecting seat 32 is formed inside the first rear shell piece 22, a second projecting seat 34 is formed inside the second rear shell piece 24, and the positioning pin 28 and the pin hole 30 of the positioning mechanism 26 may be formed on the first projecting seat 32 and the second projecting seat 34, respectively. Also, a first stopper edge 36 is formed on one end of the first rear shell piece 22, and a second stopper edge 38 is formed on one end of the second rear shell piece 24.

A first inner module 40 and a second inner module 50 are combined with the first and second circuit boards 14 and 142, respectively. The circuit board 14 projects from an end surface 42 of the first inner module 40, and the circuit board 142 projects from an end surface 52 of the second inner module 50.

Furthermore, each of two opposite side surfaces of the first inner module 40 is formed with a first slot 44, and each of two opposite corner positions of one end is formed with a first depressed edge 46. Similarly, each of two opposite side surfaces of the second inner module 50 is formed with a second slot 54, and each of two opposite corner positions of one end is formed with a second depressed edge 56.

Figure 3:
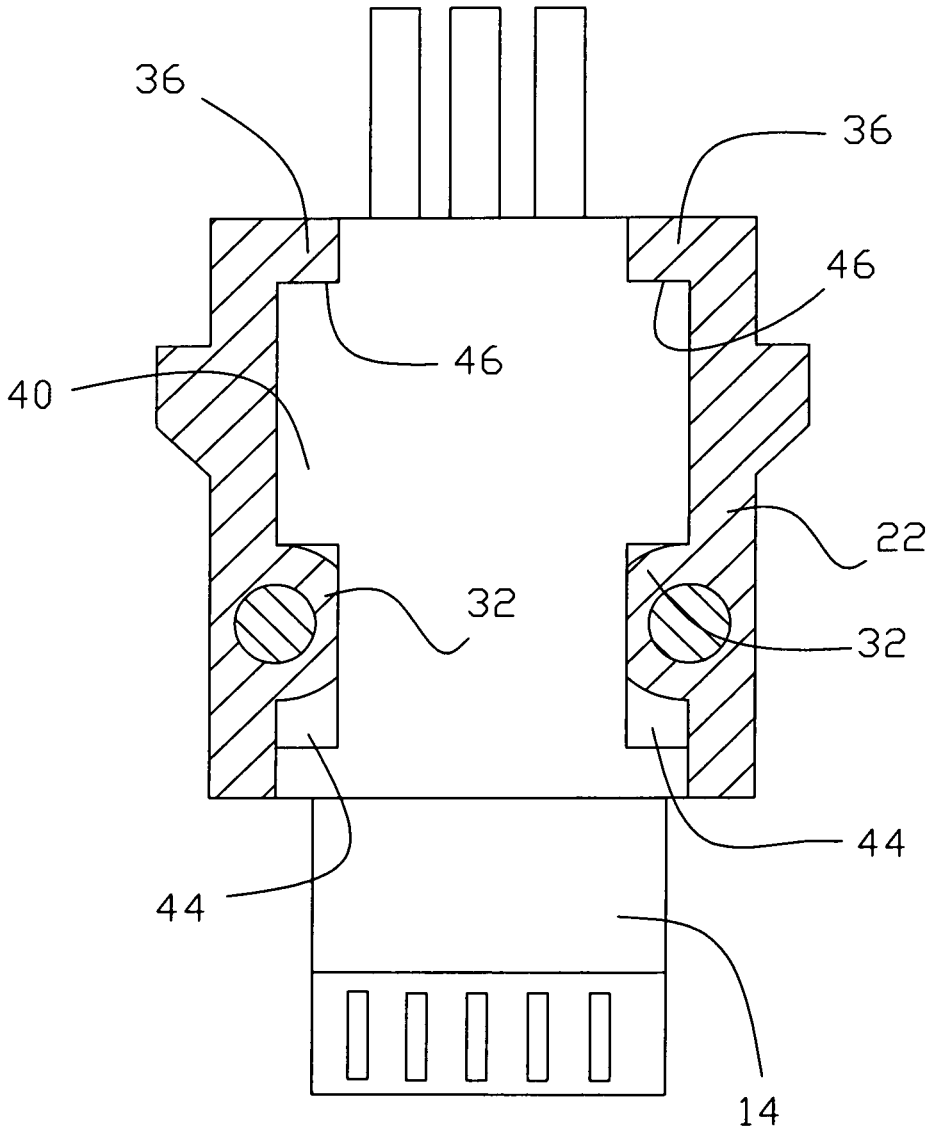
FIG. 3 is a schematic view showing a combination structure of a first inner module and a first rear shell piece of the invention.

Referring to FIG. 3, when the combination of the first inner module 40 and the circuit board 14 is mounted in the first rear shell piece 22, the first projecting seat 32 can be embedded into the first slot 44, and the first stopper edge 36 rests against the first depressed edge 46. In other words, the combination of the first inner module 40 and the circuit board 14 can be firmly combined with the first rear shell piece 22.

Figure 4:
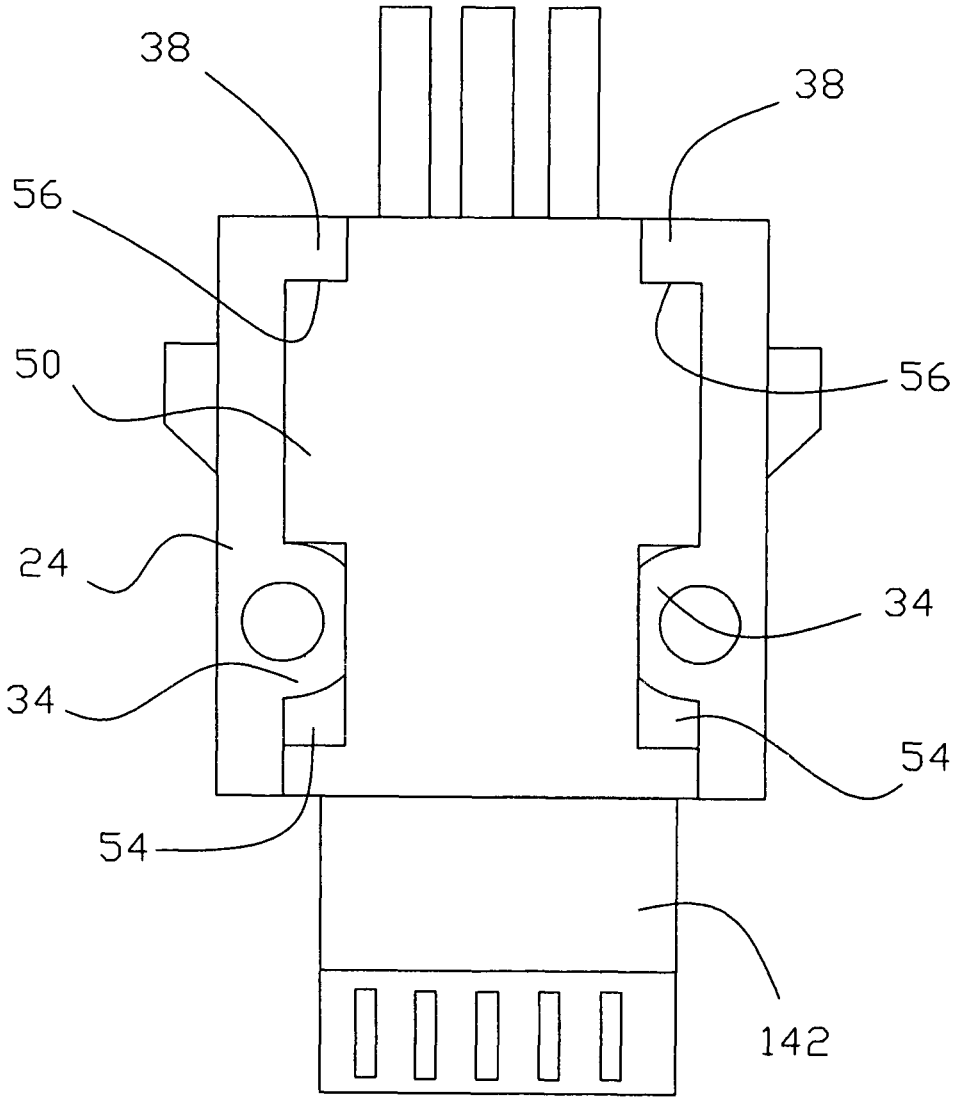
FIG. 4 is a schematic view showing a combination structure of a second inner module and a second rear shell piece of the invention.

Referring to FIG. 4, when the combination of the second inner module 50 and the circuit board 142 is mounted in the second'rear shell piece 24, the second projecting seat 34 can be embedded into the second slot 54, and the second stopper edge 38 rests against the second depressed edge 56. In other words, the combination of the second inner module 50 and the circuit board 142 can be firmly combined with the second rear shell piece 24.

Figure 5:
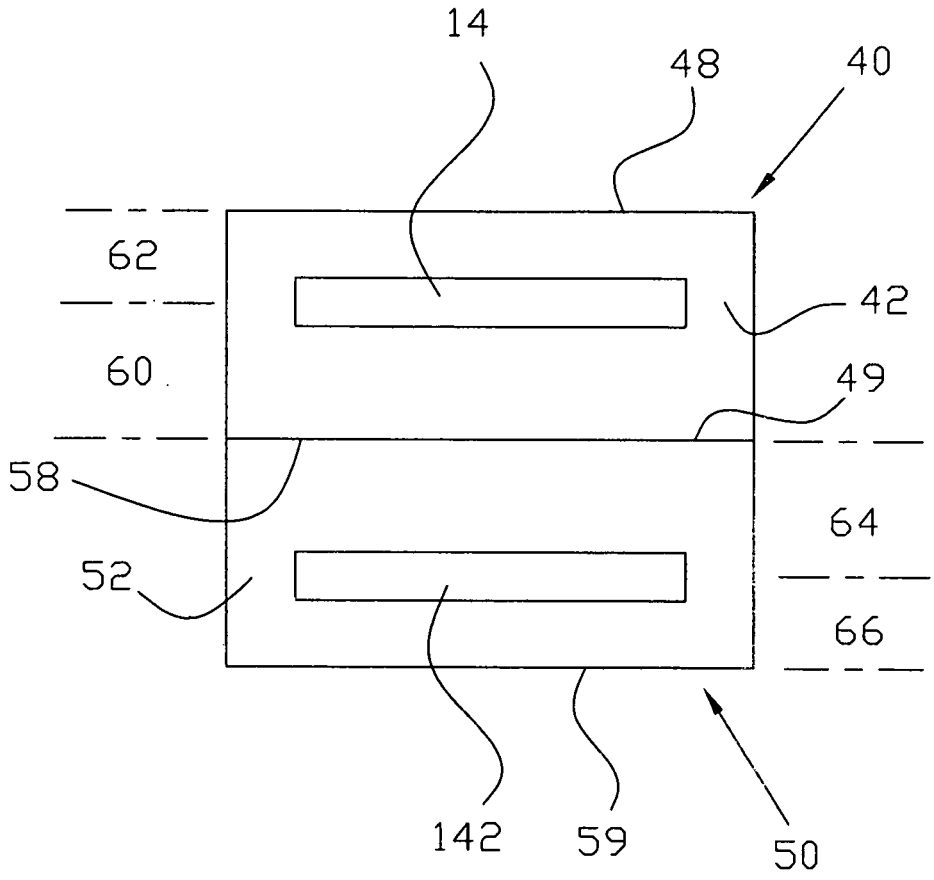
FIG. 5 is a schematic combination view showing the first inner module, the second inner module and circuit boards of the invention.

Referring to FIG. 5, the circuit board 14 is combined with the first inner module 40, and the circuit board 14 projects from the end surface 42 of the first inner module 40. It is to be noted that the end surface 42 is disposed between the upper surface 48 and the lower surface 49 of the first inner module 40, and the distances from the circuit board 14 to the upper surface 48 and the lower surface 49 of the first inner module 40 are unequal to each other. In other words, the circuit board 14 and the first inner module 40 form an offset mounting state, and a first thick portion 60 and a first thin portion 62 are formed according to a gap distant from the surface.

The circuit board 142 projects from the end surface 52 of the second inner module 50, and the end surface 52 is disposed between the upper surface 58 and the lower surface 59 of the second inner module 50. In addition, the distances from the circuit board 142 to the upper surface 58 and the lower surface 59 of the second inner module 50 are unequal to each other. In other words, the circuit board 142 and the second inner module 50 form an offset mounting state, and a second thick portion 64 and a second thin portion 66 are formed according to the gap distance from the surface.

When the connector is being assembled, the first thick portion 60 of the first inner module 40 rests against the second thick portion 64 of the second inner module 50, so that the constant gap is formed between the two circuit boards 14 and 142 to facilitate the worker in performing the assembling processes.

Thus, this embodiment can make the combination length of the front housing 10 and the rear housing 20 be 15 mm. Thus, the problem of the too large sway swing angle caused by the length design of the connector can be solved, and the condition of the unstable signal can be improved. Furthermore, the small size can decrease the condition of the interference with other mechanisms, enhance the space availability and enhance the matching degree with other mechanisms.

The first inner module 40 and the second inner module 50 are independent members to be combined with the circuit boards 14 and 142, respectively, and may be manufactured more simply. Also, the circuit board 14 is mounted on the first inner module 40 and the second inner module 50 in an offset manner. When the first inner module 40 rests against the second inner module 50, two thick portions 60 and 64 rest against each other, so that the working time is shortened, the yield is increased, and the stability of the cable impedance is held.

Also, as shown in FIGS. 3 and 4, the first inner module 40 and the second inner module 50 are restricted by the first projecting seat 32, the second projecting seat 34, the first stopper edge 36 and the second stopper edge 38. So, the first inner module 40 and the second inner module 50 can obtain the stable positioning effect.

When the front housing 10 and the rear housing 20 form the connector pattern shown in FIG. 1 and the connector is inserted at the predetermined position or removed from the predetermined position, both the first inner module 40 and the second inner module 50 cannot generate the distinct displacement. In other words, the circuit boards 14 and 142 cannot generate the distinct displacement due to the inserting and removing operations of the connector, so that the connector has the stable connection effect.

Referring again to FIGS. 1 and 2, a first combination mechanism 70 is disposed between the front housing 10 and the rear housing 20. The first combination mechanism 70 provides the combination effect when the front housing 10 and the rear housing 20 are combined together. Moreover, the first combination mechanism 70 is a combination of a first projection 72 and a first combination hole 74. The first projection 72 may be formed on opposite two side surfaces of the first rear shell piece 22, and on opposite two side surfaces of the second rear shell piece 24. The first combination hole 74 may be formed on opposite two side surfaces of the front housing 10. However, the numbers and positions of the first projection(s) 72 and the first combination hole(s) 74 in the drawings are only for the illustrative purpose only, and the invention is not particularly restricted thereto.

Figure 6:
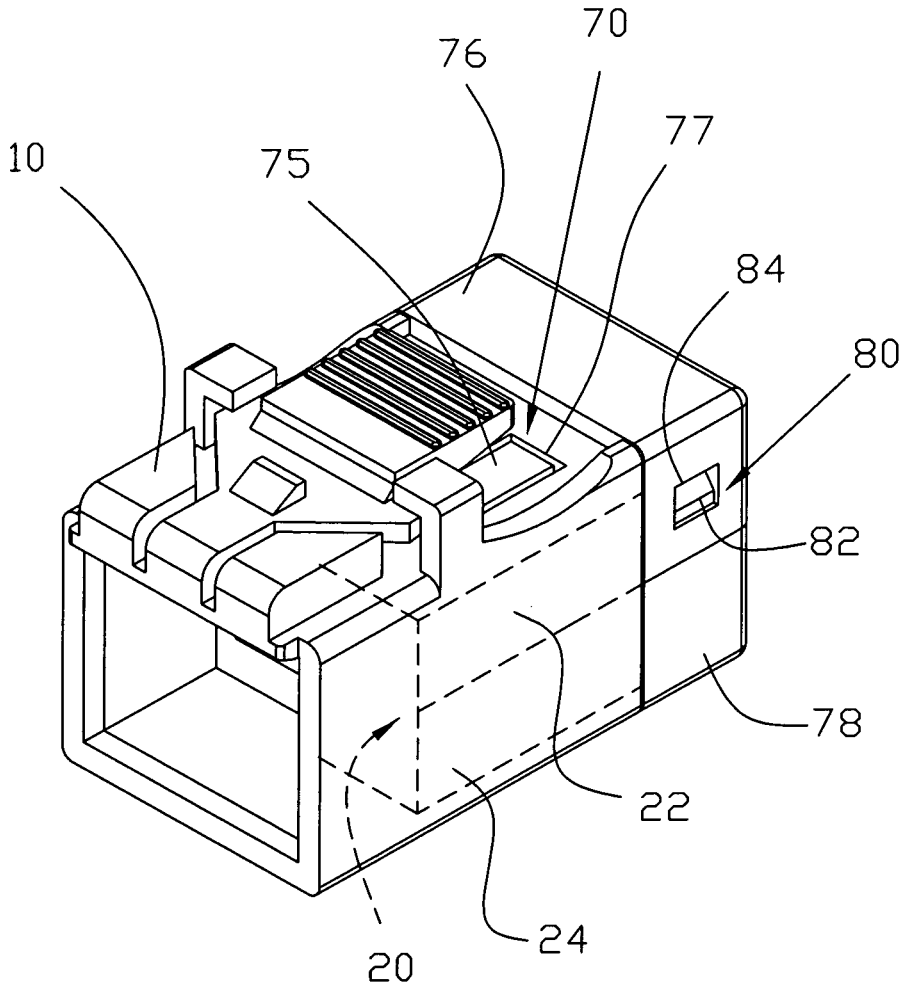
FIG. 6 is a pictorial view showing a second embodiment of the invention.
Figure 7:
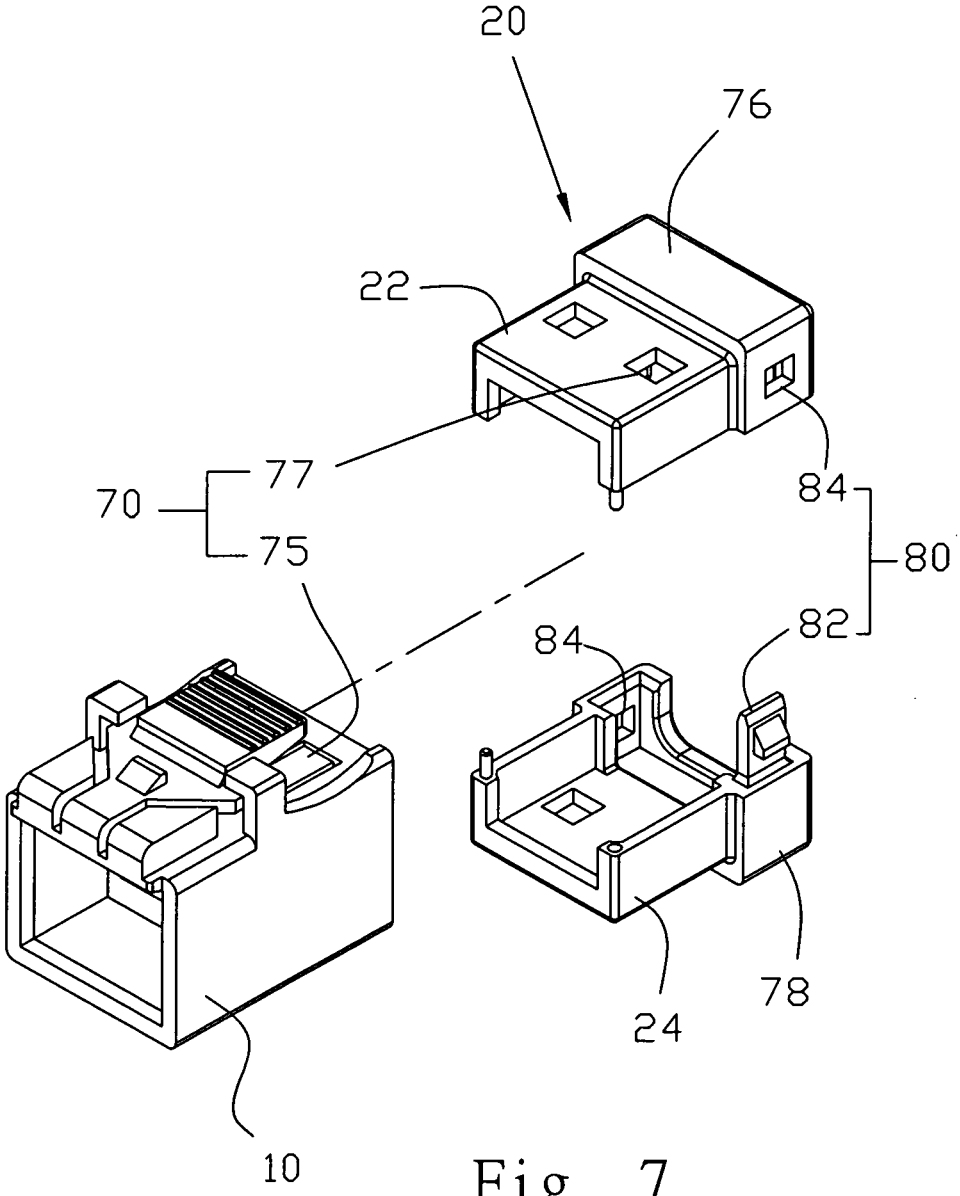
FIG. 7 is an exploded view showing the second embodiment of the invention.

As shown in FIGS. 6 and 7, the connector according to the second embodiment of the invention may be referred to as a long type mini SAS HD connector. The housing of the connector comprises a front housing 10 and a rear housing 20. The rear housing 20 comprises a first rear shell piece 22 and a second rear shell piece 24, one end of the first rear shell piece 22 is extended to form a first rear seat 76, and one end of the second rear shell piece 24 is extended to form a second rear seat 78. In addition, the rear housing 20 is axially inserted into the front housing 10, and the first rear seat 76 and the second rear seat 78 project from one end of the front housing 10.

A second combination mechanism 80 is formed between the first rear seat 76 and the second rear seat 78, and the second combination mechanism 80 may comprise a second elastic sheet 82 and a second retaining hole 84. Furthermore, one side of the first rear seat 76 may be provided with the second elastic sheet 82, and the opposite side of the first rear seat 76 may be provided with the second retaining hole 84. Similarly, one side of the second rear seat 78 may be provided with the second elastic sheet 82, and the opposite side of the second rear seat 78 may be provided with the second retaining hole 84. Thus, when the first rear shell piece 22 and the second rear shell piece 24 are combined, the second combination mechanism 80 provides the combination effect.

The front housing 10 and the rear housing 20 may be combined together in conjunction with the first combination mechanism 70. In this embodiment, the first combination mechanism 70 comprises one or more than one first elastic sheet 75 and one or more than one first retaining hole 77. The first elastic sheets 75 may be disposed on the top surface and the bottom surface of the front housing 10, and the first retaining holes 77 may be disposed on the first rear shell piece 22 and the second rear shell piece 24, respectively. However, the numbers and positions of the first elastic sheet(s) 75 and the first retaining hole(s) 77 in the drawings are only for the illustrative purpose only, and the invention is not particularly restricted thereto.

In addition, in the actual product, the structures shown in FIGS. 6 and 7 may be the same as those shown in FIGS. 1 and 2, and have the combination of the first inner module 40, the second inner module 50 and the circuit boards 14 and 142. In addition, the first inner module 40 and the second inner module 50 work in conjunction with the first rear shell piece 22 and the second rear shell piece 24 to have the good assembling property and positioning effect.

Figure 8:
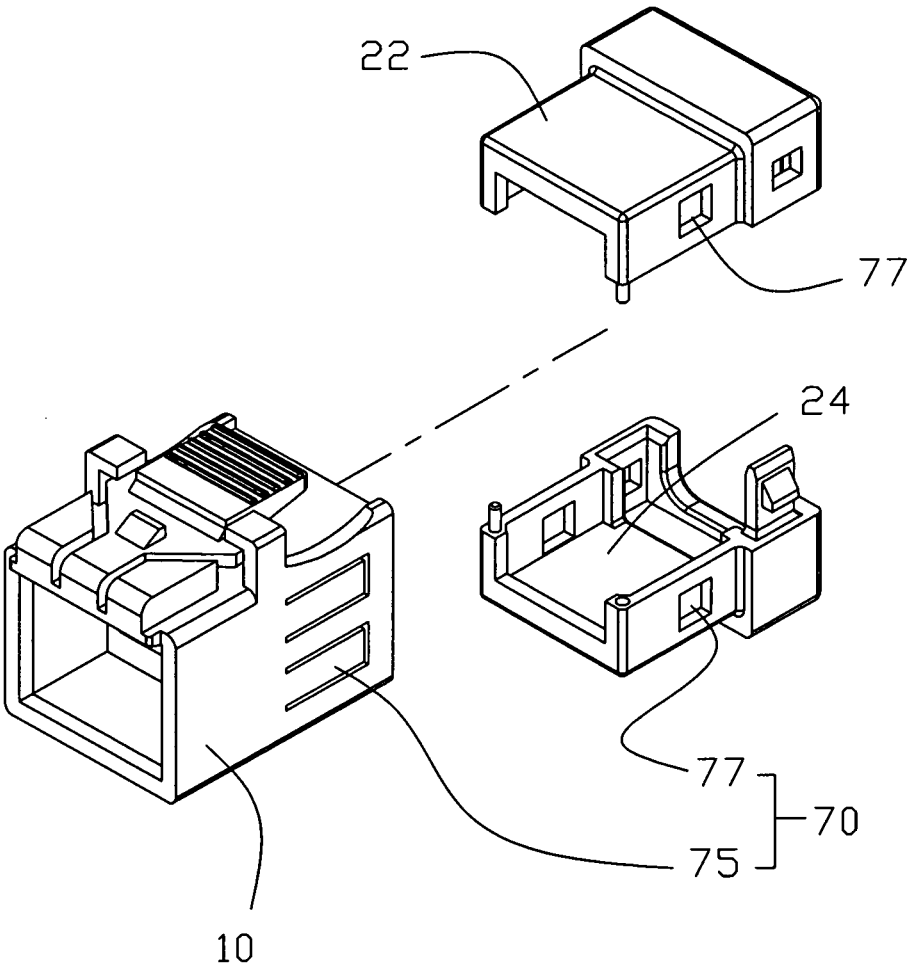
FIG. 8 is an exploded view showing a third embodiment of the invention.

Referring to FIG. 8, the first combination mechanism 70 comprises the first elastic sheet(s) 75 and the first retaining hole(s) 77. The first elastic sheet 75 may be disposed on the lateral side surface of the front housing 10, and the first retaining holes 77 may be disposed on the lateral side surfaces of the first rear shell piece 22 and the second rear shell piece 24.

Figure 9:
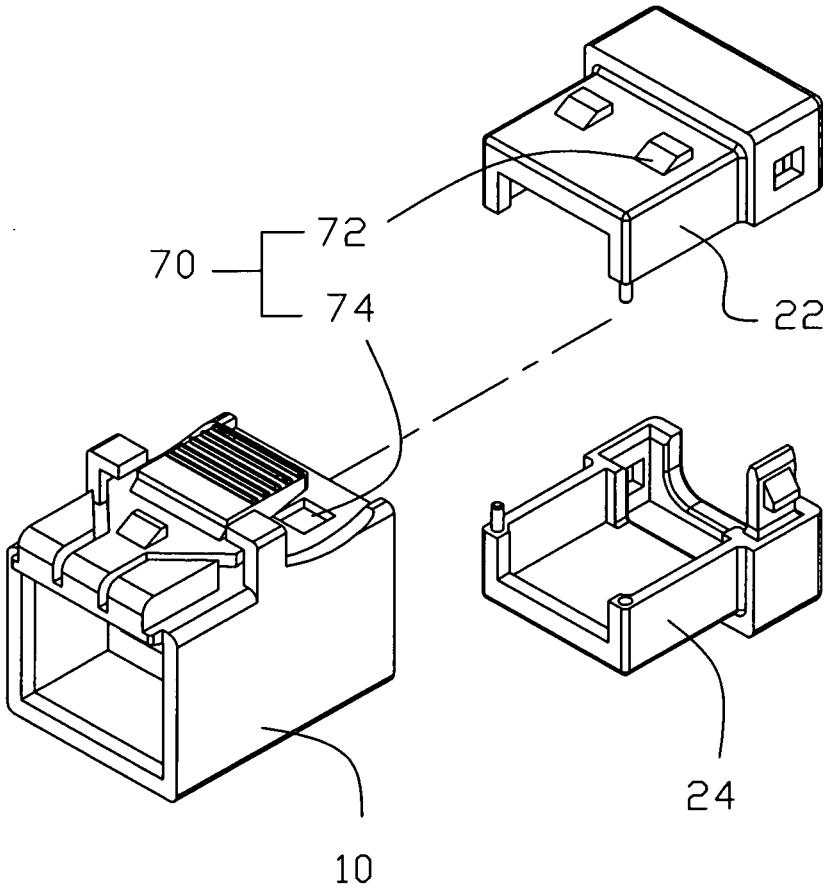
FIG. 9 is an exploded view showing a fourth embodiment of the invention.

Referring to FIG. 9, the first combination mechanism 70 is the combination of the first projection(s) 72 and the first combination hole(s) 74. The first projections 72 may be formed on the top surface of the first rear shell piece 22 and the top surface of the second rear shell piece 24, respectively. The first combination holes 74 are formed on the top surface and the bottom surface of the front housing 10. Therefore, the combination of the first rear shell piece 22 and the second rear shell piece 24 can further form the stable combination state by embedding the first projection 72 into the first combination hole 74.

Figure 10:
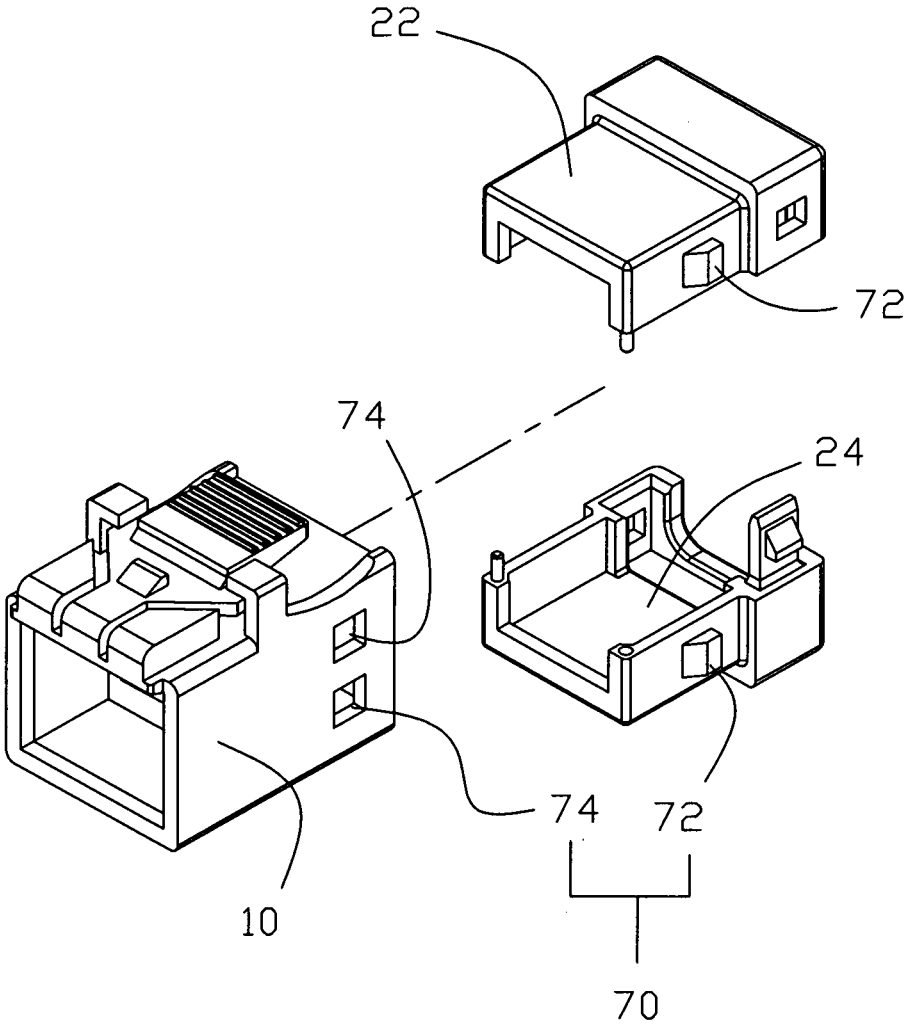
FIG. 10 is an exploded view showing a fifth embodiment of the invention.

Referring to FIG. 10, the first combination mechanism 70 comprises the first projection(s) 72 and the first combination hole(s) 74. The first projections 72 may be disposed on the lateral side surfaces of the first rear shell piece 22 and the second rear shell piece 24, and the first combination hole 74 is disposed on the lateral side surface of the front housing 10.

Figure 11:
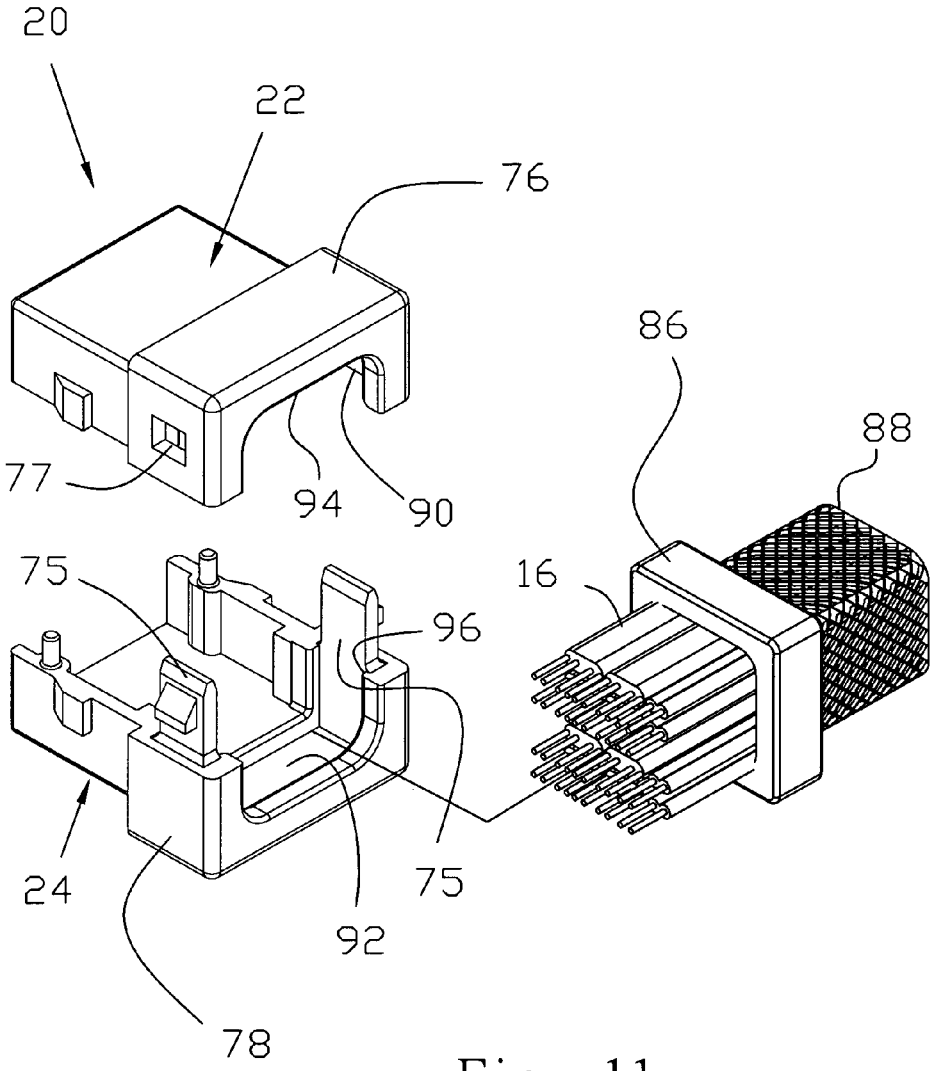
FIG. 11 is an exploded view showing a rear housing, a frame and a braided mesh of the invention.
Figure 12:
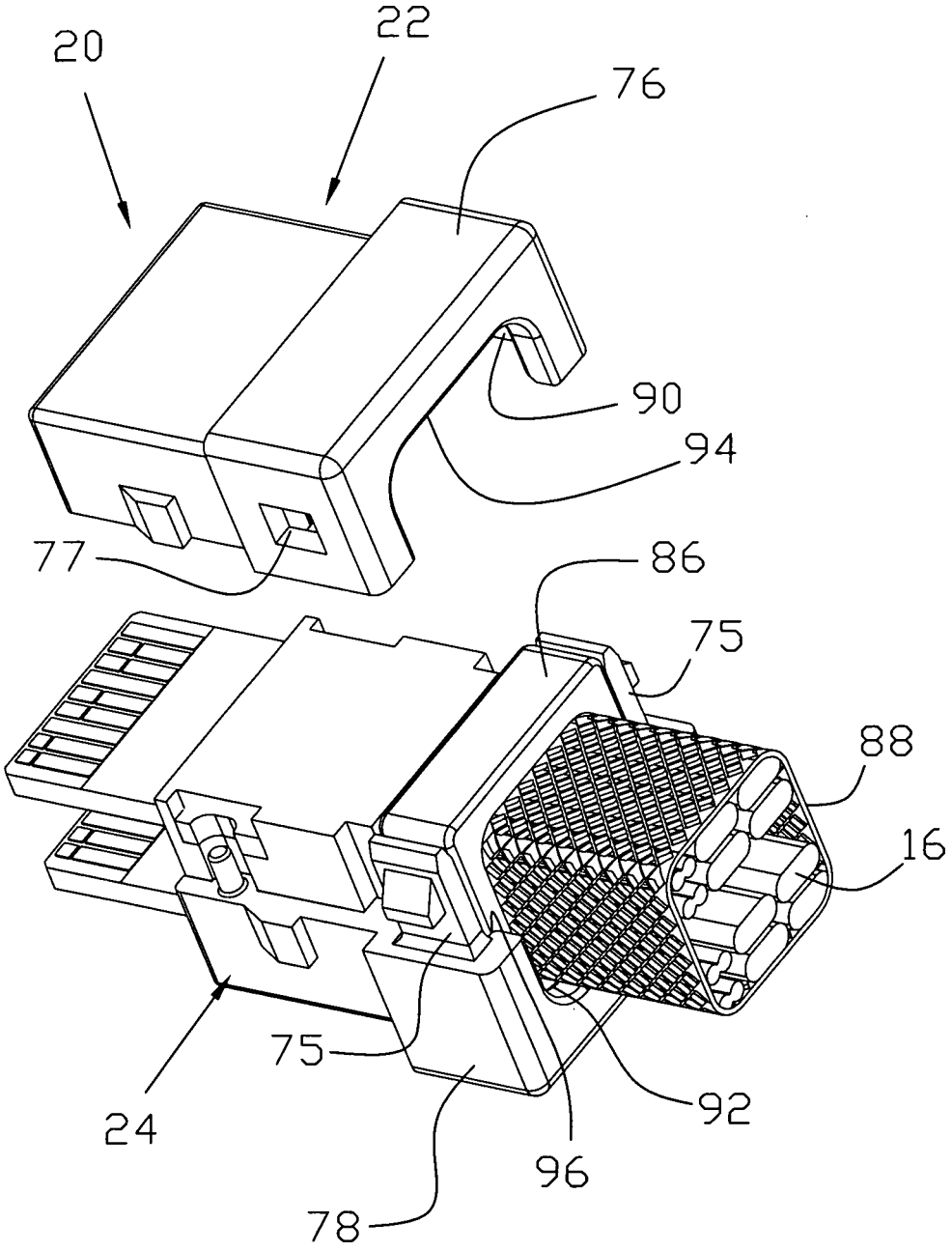
FIG. 12 is a schematic combination view showing the rear housing, the frame and the braided mesh of the invention.

Base on the structure of the embodiment of the invention, the invention further discloses the technological means of solving the fixing problem of a braided mesh. Referring to FIGS. 11 and 12, a frame 86 is disposed on one end of the combination of the cable 16 and the braided mesh 88. Next, a first accommodating slot 90 is formed in the first rear seat 76 of the first rear shell piece 22, and the second rear seat 78 of the second rear shell piece 24 has a second accommodating slot 92. The frame 86 is mounted in the space constituted by the first accommodating slot 90 and the second accommodating slot 92. Furthermore, as shown in FIG. 12, the frame 86 is disposed between two opposite first elastic sheets 75, so that the frame 86 cannot interfere with the combination of the first elastic sheet 75 and the first retaining hole 77. In addition, the edge of the first accommodating slot 90 may be formed with a first anti-off stopper edge 94, and the edge of the second accommodating slot 92 may be formed with a second anti-off stopper edge 96. Thus, after the first accommodating slot 90 and the second accommodating slot 92 are docked, a space may be formed, and the frame 86 is mounted in the space and can stop the frame 86 through the first anti-off stopper edge 94 and the second anti-off stopper edge 96, so that the frame 86 cannot escape from the rear housing 20. Furthermore, the combination of the frame 86 and the braided mesh 88 can be firmly combined with the connector.

In the prior art, a tape or an acetate cloth is used to fix the cable and the braided mesh. However, this method has the poor fixing effect on the adhered braided mesh, and the slide or detachment tends to occur. According to the above-mentioned embodiments, the invention uses one frame 86 to be combined with the braided mesh 88, wherein the frame 86 can be mounted in the rear housing 20. In other words, the rear housing 20 of the invention has the function of inwardly fastening and positioning the braided mesh 88, so that the assembling processes are simplified, and the braided mesh 88 cannot be easily moved and loosened to obtain the effect of preventing the exposed cable 16 from being damaged by the external force, to enhance the bendable property of the cable 16, and further to obtain the effect of saving the assembling and working time.

Figure 13:
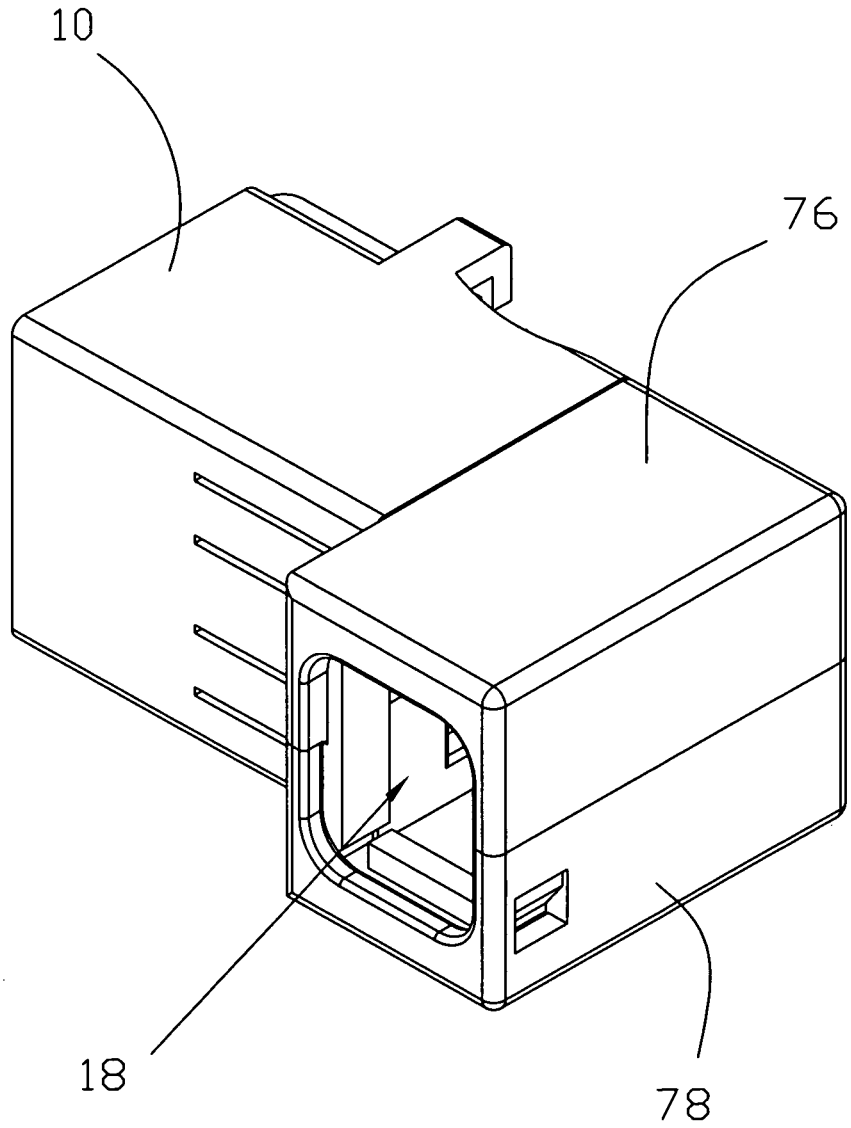
FIG. 13 is a pictorial view showing a 90-degree form of the invention.
Figure 14:
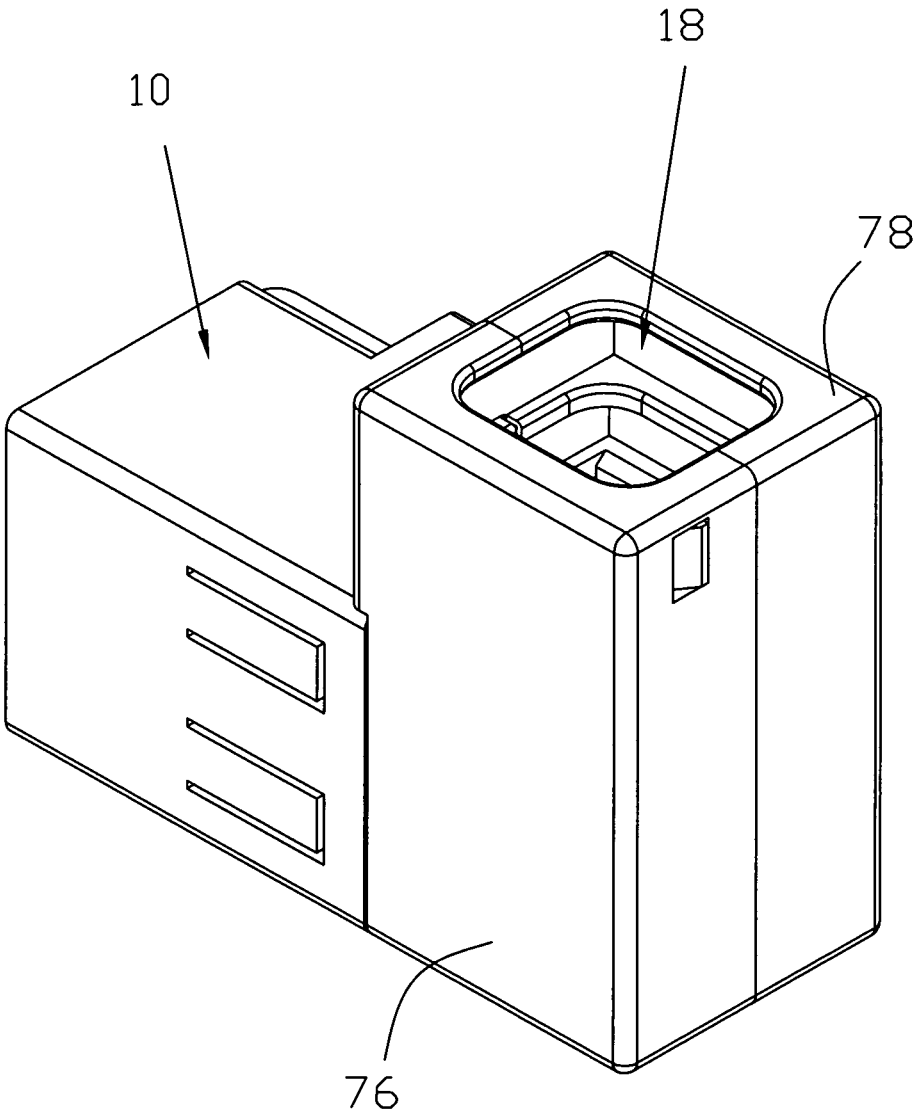
FIG. 14 is another pictorial view showing the 90-degree form of the invention.

Referring again to FIG. 6, the first rear seat 76 and the second rear seat 78 are disposed in the extending direction of the front housing 10, and the widths of the first rear seat 76 and the second rear seat 78 are equivalent to the widths of the front housing 10. So, the extending direction of the cable (not shown) is the same as the inserting direction of the front housing 10, and this combination type of connector may be referred to as a 180-degree form. As shown in FIGS. 13 and 14, the combination of the first rear seat 76 and the second rear seat 78 is disposed on one end of the front housing 10. However, the hole 18 for the insertion of the combination (not shown) of the cable, the frame and the braided mesh has turned. In other words, the difference between the extending direction of the cable and the inserting direction of the front housing 10 is equal to 90 degrees, so this combination type of connector may be referred to as a 90-degree form.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A mini serial attached SCSI high density (mini SAS HD) connector to be combined with a first circuit board, a second circuit board and a cable, the connector comprising:

a front housing, which is in the form of a frame and has an insertion space in an axial direction;

a rear housing comprising a first rear shell piece and a second rear shell piece combined together, wherein the rear housing is to be inserted into the insertion space of the front housing;

a positioning mechanism, which is disposed between the first rear shell piece and the second rear shell piece, and for providing a positioning effect when the first rear shell piece and the second rear shell piece are combined together;

a first combination mechanism, which is disposed between the front housing and the rear housing, and for providing a combination effect when the front housing and the rear housing are combined together;

a first inner module to be combined with the first circuit board, wherein a combination of the first inner module and the first circuit board is mounted in the first rear shell piece;

a second inner module to be combined with the second circuit board, wherein a combination of the second inner module and the second circuit board is mounted in the second rear shell piece;

a first stopper edge formed on the first rear shell piece;

a second stopper edge formed on the second rear shell piece;

a first depressed edge formed at corner positions on two sides of the first inner module; and a second depressed edge formed at corner positions on two sides of the second inner module, wherein when the first inner module is combined with the first rear shell piece, the first depressed edge rests against the first stopper edge; and when the second inner module is combined with the second rear shell piece, the second depressed edge rests against the second stopper edge.

2. The connector according to claim 1, further comprising a first projecting seat formed on the first rear shell piece, a second projecting seat formed on the second rear shell piece, a first slot formed on a lateral side of the first inner module, and a second slot formed on a lateral side of the second inner module, wherein the positioning mechanism is formed on the first projecting seat and the second projecting seat, and when the first rear shell piece and the second rear shell piece are combined together, the first projecting seat is embedded into the first slot and the second projecting seat is embedded into the second slot.

3. The connector according to claim 1, wherein the positioning mechanism is a combination of a positioning pin and a pin hole.

4. The connector according to claim 1, wherein the first circuit board is combined with the first inner module, the first circuit board projects from an end surface of the first inner module, the end surface is disposed between an upper surface and a lower surface of the first inner module, and distances from the first circuit board to the upper surface and the lower surface of the first inner module are unequal to each other to form a first thick portion and a first thin portion.

5. The connector according to claim 1, wherein the second circuit board is combined with the second inner module, the second circuit board projects from an end surface of the second inner module, the end surface is disposed between an upper surface and a lower surface of the second inner module, and distances from the second circuit board to the upper surface and the lower surface of the second inner module are unequal to each other to form a second thick portion and a second thin portion.

6. The connector according to claim 1, wherein the first combination mechanism is a combination of an elastic sheet and a retaining hole.

7. The connector according to claim 1, wherein the first combination mechanism is a combination of a first projection and a first combination hole.

8. A mini serial attached SCSI high density (mini SAS HD) connector to be combined with a first circuit board, a second circuit board and a cable, the connector comprising:

a front housing, which is in the form of a frame and has an insertion space in an axial direction;

a rear housing comprising a first rear shell piece and a second rear shell piece combined together, wherein the rear housing is to be inserted into the insertion space of the front housing;

a positioning mechanism, which is disposed between the first rear shell piece and the second rear shell piece, and for providing a positioning effect when the first rear shell piece and the second rear shell piece are combined together;

a first combination mechanism, which is disposed between the front housing and the rear housing, and for providing a combination effect when the front housing and the rear housing are combined together;

a first inner module to be combined with the first circuit board, wherein a combination of the first inner module and the first circuit board is mounted in the first rear shell piece;

a second inner module to be combined with the second circuit board, wherein a combination of the second inner module and the second circuit board is mounted in the second rear shell piece; and a first rear seat formed on one end of the first rear shell piece, a second rear seat formed on one end of the second rear shell piece, and a second combination mechanism formed between the first rear seat and the second rear seat, wherein a combination of the first rear shell piece and the second rear shell piece provides the combination effect through the second combination mechanism.

9. The connector according to claim 8, wherein the second combination mechanism is a combination of a second elastic sheet and a second retaining hole.

10. The connector according to claim 8, further comprising a combination of a frame and a braided mesh, wherein the cable passes through the braided mesh and is connected to the first circuit board and the second circuit board, the frame is mounted in an inner space in back of a combination of the first rear seat and the second rear seat, and the braided mesh covers the cable.

11. The connector according to claim 10, wherein a first accommodating slot is formed inside the first rear seat, a second accommodating slot is formed inside the second rear seat, and the frame is mounted in the first accommodating slot and the second accommodating slot.

12. The connector according to claim 11, wherein an edge of the first accommodating slot is formed with a first anti-off stopper edge, an edge of the second accommodating slot is formed with a second anti-off stopper edge, and the first anti-off stopper edge and the second anti-off stopper edge are for stopping the frame.

* * * * *